US007258052B1

(12) United States Patent
McLean

(10) Patent No.: US 7,258,052 B1
(45) **Date of Patent: *Aug. 21, 2007**

(54) APPARATUS FOR REMOVING THE TIPS OF TABLET PUNCHES

(75) Inventor: Steven McLean, Pt. Pleasant, NJ (US)

(73) Assignee: Stevens Pharmaceutical Equipment Industries, LLC, Farmingdale, NJ (US)

( * ) Notice: Subject to any disclaimer, the term of this patent is extended or adjusted under 35 U.S.C. 154(b) by 403 days.

This patent is subject to a terminal disclaimer.

(21) Appl. No.: 10/805,699

(22) Filed: Mar. 22, 2004

Related U.S. Application Data

(63) Continuation-in-part of application No. 10/122,260, filed on Apr. 12, 2002, now Pat. No. 6,857,346.

(51) Int. Cl.
*B26D 1/143* (2006.01)

(52) U.S. Cl. ..... 83/168; 83/169; 83/411.1; 83/676

(58) Field of Classification Search ..... 83/411.1, 83/733, 410.9, 169, 932, 411.2, 411.3, 171, 83/168, 676, 411.5, 411.6, 944; 225/26; 99/643

See application file for complete search history.

(56) References Cited

U.S. PATENT DOCUMENTS

| | | | | |
|---|---|---|---|---|
| 2,062,739 A | | 12/1936 | Canaday | |
| 2,256,146 A | | 9/1941 | Knott | |
| 2,309,396 A | | 1/1943 | Jackson | |
| 2,621,692 A | | 12/1952 | Urschel | |
| 2,793,665 A | | 5/1957 | Pinard | |
| 2,877,816 A | | 5/1959 | Kibler | |
| 3,154,124 A | | 10/1964 | Cimino | |
| 3,810,405 A | * | 5/1974 | Orberloier | 83/100 |
| 3,955,455 A | * | 5/1976 | Guzman | 83/409.1 |
| 4,608,892 A | * | 9/1986 | Noizet | 83/168 |
| 5,167,178 A | | 12/1992 | Cimperman et al. | |
| 5,704,828 A | | 1/1998 | Young et al. | |
| 6,857,346 B1 | * | 2/2005 | McLean | 83/169 |

* cited by examiner

*Primary Examiner*—Kenneth E. Peterson
(74) *Attorney, Agent, or Firm*—Norman E. Lehrer

(57) ABSTRACT

A machine for removing the tips of tablet punches includes a housing that contains a turret that is rotated about a substantially vertical axis and a cutting wheel. The turret supports a plurality of tablet punches in a substantially vertical position with the tips of the punches being exposed below the turret. A cutting wheel is positioned below the turret and is located in a position so as to be in the path of the tips as the turret rotates. A motor rotates the cutting wheel so that the tips are removed from the punches as they are rotated into the path of the wheel. A nozzle is directed to the position where the cutting wheel engages the tips of the punches and sprays a cooling fluid in order to cool the cutting wheel and tips to prevent overheating thereof.

5 Claims, 5 Drawing Sheets

APPARATUS FOR REMOVING THE TIPS OF TABLET PUNCHES

CROSS REFERENCE TO RELATED APPLICATION

This application is a Continuation-in-Part of prior U.S. application Ser. No. 10/122,260, filed Apr. 12, 2002, now U.S. Pat. No. 6,857,346.

BACKGROUND OF THE INVENTION

The present invention is directed toward an apparatus for destroying a tablet punch and more particularly, toward a machine with a cutting wheel that removes the tip of a tablet punch.

Tablets for use as drugs and for other pharmaceutical purposes are typically made by depositing a quantity of the medicinal powder into a die and compressing the powder. This is accomplished by lowering and raising a pair of punches onto the powdered material in the die. The punches are located on turrets that rotate about their respective vertical axis. Some punches have a recessed end portion so that the tablet will have a domed or beveled surface. The recessed portion of one or both of the punches frequently has some type of marking such as a letters, numbers, logos or other indicia thereon which information is transferred onto each tablet. The indicia may provide information concerning the type or dose of the medication or the manufacturer thereof.

The punches discussed above eventually do wear out and must be replaced. Furthermore, they are frequently replaced before they are worn when a particular medication is no longer being produced or when it is desired to change the indicia on the tablets. The Food and Drug Administration in the United States requires that the end portion or tip of each punch be ground or cut off before disposing of the same in order to ensure that the punches will not be improperly reused by others. Undoubtedly, regulatory agencies in other countries have similar requirements.

At present, a grinding wheel is used to grind the ends of each of the punches before they are disposed of. This is done manually by a worker holding the punch and forcing the tip thereof onto the surface of the grinding wheel. However, there are many problems, disadvantages, and safety issues involved in this procedure. Primarily, it is a time-consuming and tedious process as only one punch may be worked on at a time. There is also the possibility that the indicia may not be totally removed and that the punch is then reused. Even further, there is always the danger of injury to the worker who is manually grinding the tips with the grinding wheel.

Therefore, a safe and efficient process for grinding the ends of tablet punches before their disposal is needed.

SUMMARY OF THE INVENTION

The present invention is designed to overcome the deficiencies of the prior art discussed above. It is an object of the present invention to provide a machine for removing the tips of tablet punches.

It is another object of the present invention to provide a safe and efficient process for cutting off the tips of tablet punches before they are disposed of.

In accordance with the illustrative embodiments demonstrating features and advantages of the present invention, there is provided a machine for cutting off the tips of tablet punches. The machine includes a housing that contains a turret that is rotated about a substantially vertical axis and a cutting wheel or disc positioned below the turret. The turret supports or holds a plurality of tablet punches in a substantially vertical position with the tips of the punches being exposed below the turret. A plurality of circular plates that can be positioned on top of the turret act as shims to adjust the length of the tip that is exposed.

The cutting wheel is located in a position so as to be in the path of the tips as the turret rotates. A motor rotates the cutting wheel so that the tips are removed from the punches as they rotate into the path of the cutting wheel. The turret rotates at a relatively low speed and the cutting wheel rotates at a relatively high speed. A nozzle is directed toward the position where the cutting wheel engages the tips of the punches and sprays a cooling fluid in order to cool the cutting wheel and tips as they are being cut. A watertight tank accessible from the rear of the housing surrounds the lower portion of the turret and collects the spent fluid along with the metal filings and grindings from the cutting wheel.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

DETAILED DESCRIPTION OF THE PREFERRED EMBODIMENT

Figure 1:
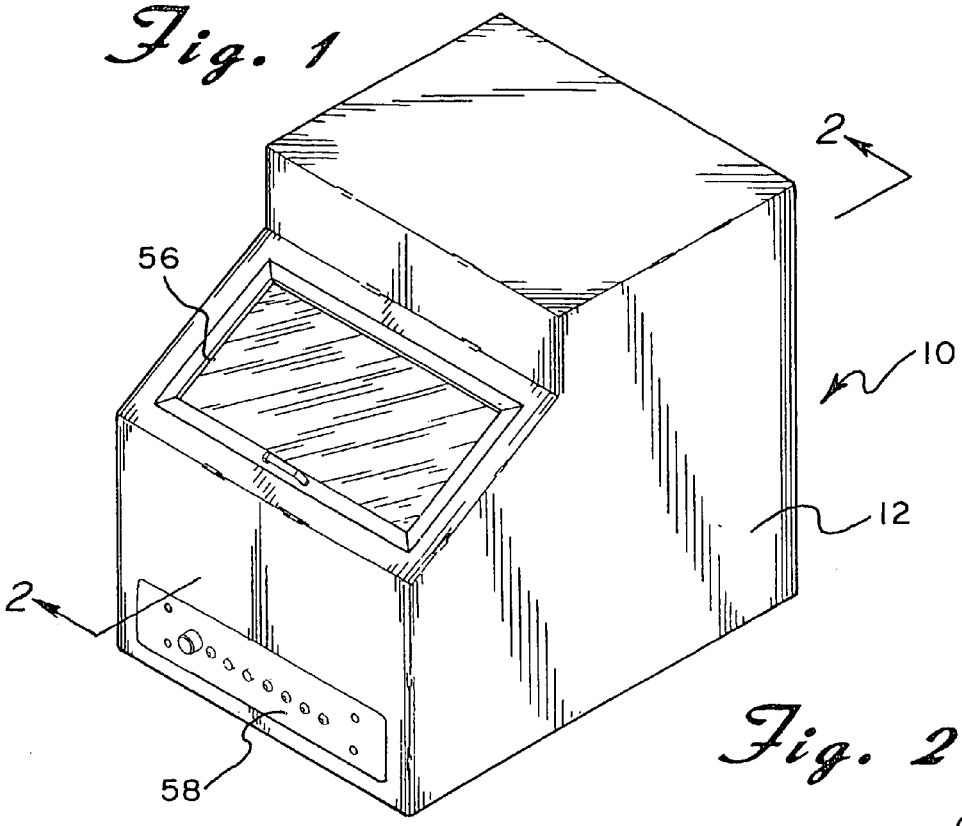
FIG. 1 is a front perspective view of the apparatus of the present invention.

Referring now to the drawings in detail wherein like reference numerals have been used throughout the various figures to designate like elements, there is shown in FIG. 1 an apparatus constructed in accordance with the principles of the present invention and designated generally as 10.

Figure 3:
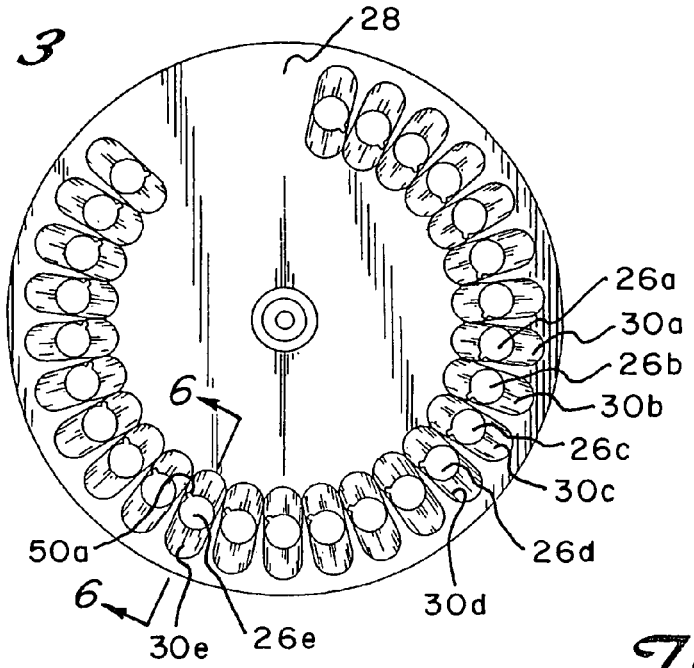
FIG. 3 is a top plan view of the punch holding turret taken along line 3-3 of FIG. 2.
Figure 4:
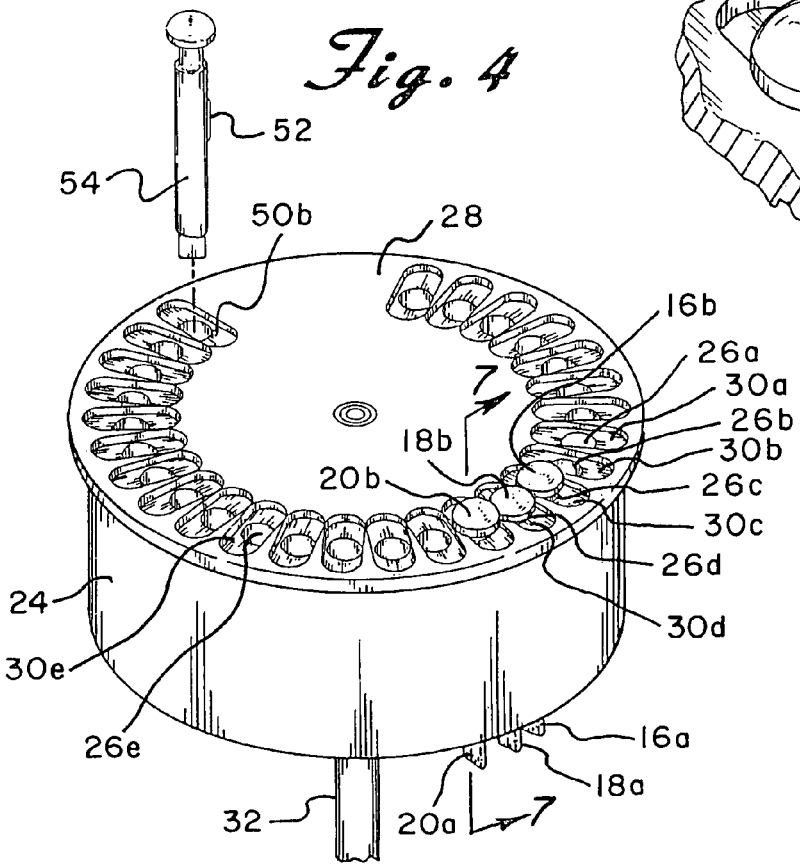
FIG. 4 is an exploded view of a punch being inserted into the turret of the present invention.
Figure 7:
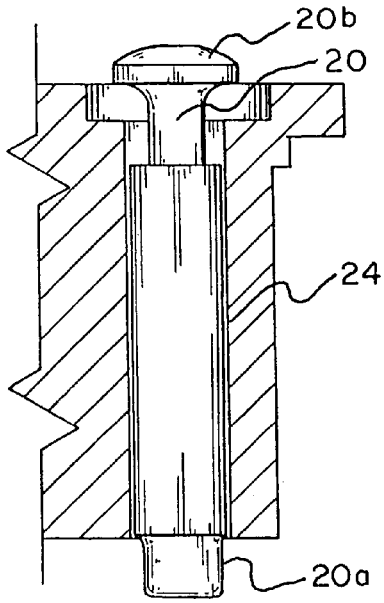
FIG. 7 is a cross-sectional view taken through line 7-7 of FIG. 4.

The apparatus of the present invention essentially includes a housing 12 which contains therein all of the operative devices for performing the required cutting operation. More particularly, mounted within the housing 12 is a means 14 for supporting or holding a plurality of tablet punches 16, 18, and 20 for example, and a cutting wheel or disc 22. The supporting means 14 may be a turret comprised of a drum 24 and a plurality of substantially vertically aligned circular holes, 26*a*-26*e* for example, around the periphery thereof. (See FIG. 3.) The drum 24 may be approximately four inches thick. Each of the holes is adapted to support a punch in a substantially vertical orientation so that the tips 16*a*, 18*a*, and 20*a* of the punches 16, 18, and 20, for example, are exposed below the turret 14. (See FIGS. 4 and 7.) By way of example, there may be twenty-eight such holes in the turret. However, and as should be readily apparent to those skilled in the art, there could be many more or substantially fewer holes thereby requiring a larger or smaller turret to be utilized.

Figure 2:
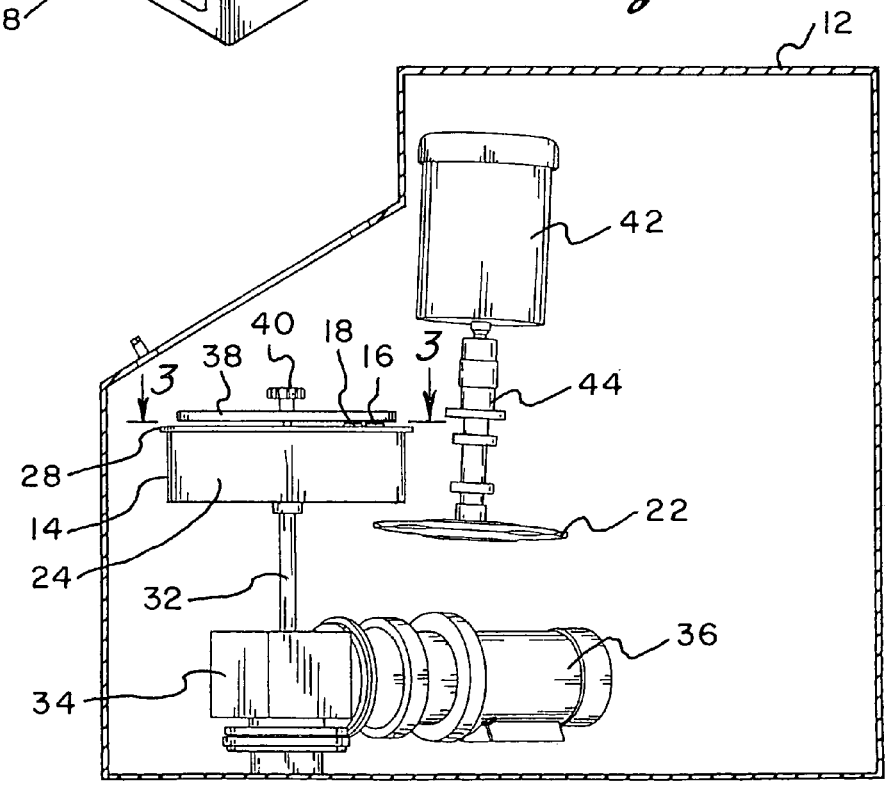
FIG. 2 is a cross-sectional view taken through line 2-2 of FIG. 1 diagramatically illustrating the internal components of the present system.

The turret 14 has an upper plate or surface 28 with a plurality of elongated openings or cutouts, shown for example as 30*a*-30*e*, located therein adjacent each of the circular holes 26*a*-26*e*. Attached to the turret 14 via a drive shaft 32 is a gear box 34 and motor 36. (See FIG. 2.) The motor 36, through the gear box 34, causes the turret 14 to rotate about a substantially vertical axis at a rate of approximately once every forty minutes. Obviously, the speed of the turret could be faster or slower as may be desired. As shown best in FIG. 2, a cover 38 in the form of a circular plate is secured over the openings via screw 40 and holds the punches in place as they are being worked on as will be described in greater detail below.

The cutting wheel 22 is positioned below the turret 14. The wheel 22 is located in a position so as to be in the path of the tips 16*a*, 18*a*, and 20*a* of the punches 16, 18, and 20, respectively, as the punches 16, 18, and 20 are rotated. The wheel 22 has a diameter of approximately 10 inches and has a thickness of approximately ¼ inch. A motor 42 is attached to the wheel 22 via drive shaft 44 and drives the wheel 22 at approximately 3600 rpm. While not specifically shown, the motor 42 is supported by the housing 12 in a manner well known in the art, such as by the use of a bracket or the like.

Figure 8:
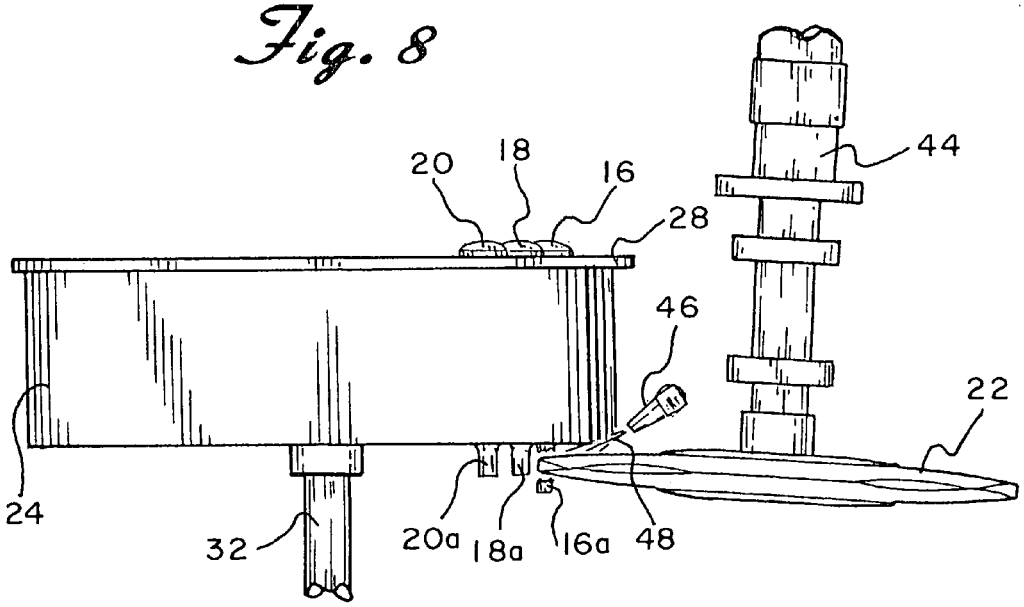
FIG. 8 illustrates the tip of a punch being cut off with the cutting wheel of the present invention.

As best shown in FIG. 8, the wheel 22 is mounted for rotation about an axis which is slightly angled from the vertical. This angle may be approximately three to five degrees. At this angle, the punches that have already been cut will not interfere with the operation of the cutting wheel 22 as they pass over the top thereof after being cut. That is, the cut punches will clear the upper surface of the cutting disc 22 as the turret 14 rotates and will not bind or otherwise engage the upper surface of the cutting wheel 22.

A nozzle 46 for spraying a cooling fluid 48 is also attached to the housing 12 in a manner well known in the art. The spray is directed to the area where the cutting disc 22 engages the tips 16*a*, 18*a*, and 20*a* of the punches 16, 18, and 20, respectively in order to cool the same to prevent overheating. The cooling fluid is preferably a liquid such as water. In the preferred embodiment of the invention, the gear box 34 and motor 36 are covered so that the liquid being sprayed does not cause damage to them. A collection pan may be located at the bottom of the housing in order to collect the spent cooling liquid. Alternatively, and as more fully described below, the lower portion of the turret, the cutting disc and the nozzle may be enclosed in a watertight tank.

Figure 5:
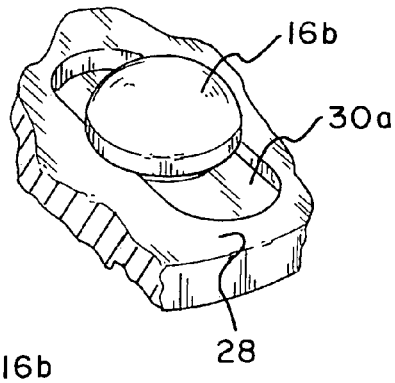
FIG. 5 is an enlarged partial top perspective view of the top of a punch inserted into the turret of the present invention.
Figure 6:
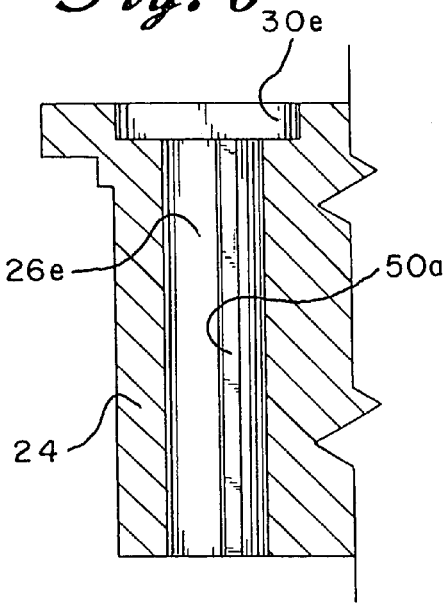
FIG. 6 is a cross-sectional view taken through line 6-6 of FIG. 3.

In order to use the apparatus of the present invention, the glass front door 58 is opened to allow the user access to the interior thereof. The cover 38 is then removed so that the punches may be placed within the holes of the turret 14. Each punch is approximately 5¼ inches long. The tips 16*a*, 18*a*, and 20*a* of the punches 16, 18, and 20, respectively, extend below the turret 14 and the enlarged heads 16*b*, 18*b*, and 20*b* of the punches 16, 18, and 20 extend above the upper plate or surface 28 of the turret 14. Each elongated opening is narrower than the diameter of its respective punch head so that the head rests above the opening. (See FIG. 5.) A key hole 50*a* is located within each circular hole, seen for example at hole 26*e*. (See FIGS. 3 and 6.) Each key hole, for example, 50*b* is aligned with a key 52 on a punch 54. (See FIG. 4.) This prevents the punch from rotating within the circular hole. The cover 38 is then screwed into place on the turret.

The door 56 is then closed and the motor 42 of the cutting disc 22 and the motor 36 of the turret 14 are then turned on using the controls 58 on the front of the housing 12. The disc 22 rotates at a relatively high speed as the turret 14 rotates at a relatively low speed. As the turret 14 rotates, the wheel 22 cuts or removes the tip of each punch. (See FIG. 8.) As discussed above, because the wheel 22 is angled slightly from the vertical, the punches that have been cut do not interfere with the operation of the wheel 22. The nozzle 46 sprays fluid at the area where the tips are being cut to prevent overheating as pointed out above.

Once all of the tips have been cut off, the motors 36 and 42 automatically stop. At this point, the door 56 may be opened. The heads of the punches can then be grasped by a worker one at a time and removed. The elongated openings allow a person's fingers to grasp the head easily for removal.

While the housing 12 is not essential to the working of the device, it does cover the entire device in order to protect workers. That is, the sparks, metal shards and abrasive material that may be produced during cutting are contained within the housing thereby preventing injury to those working in the area of the device. Furthermore, the housing allows the entire device to be self-contained and more easily moveable from one location to another if needed. The glass window in the door 56, however, allows a worker to view the progress of the operation of the apparatus.

Figure 9:
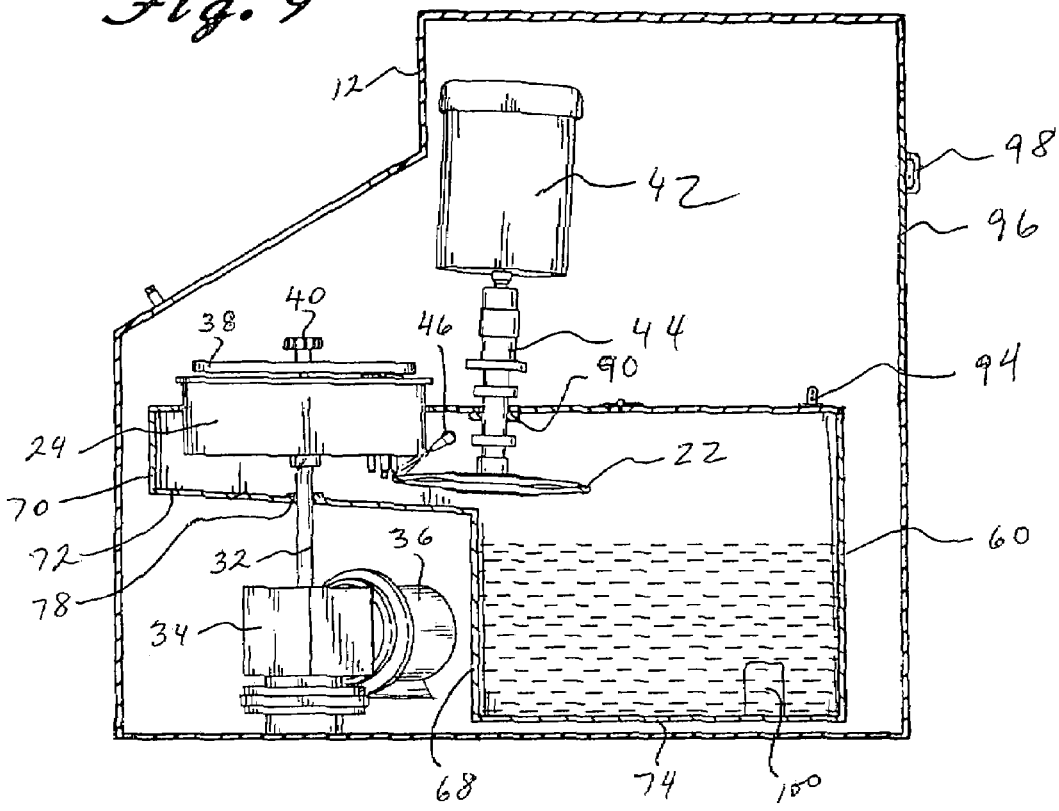
FIG. 9 is a cross-sectional view similar to FIG. 2 showing the embodiment of the invention with watertight tank.
Figure 10:
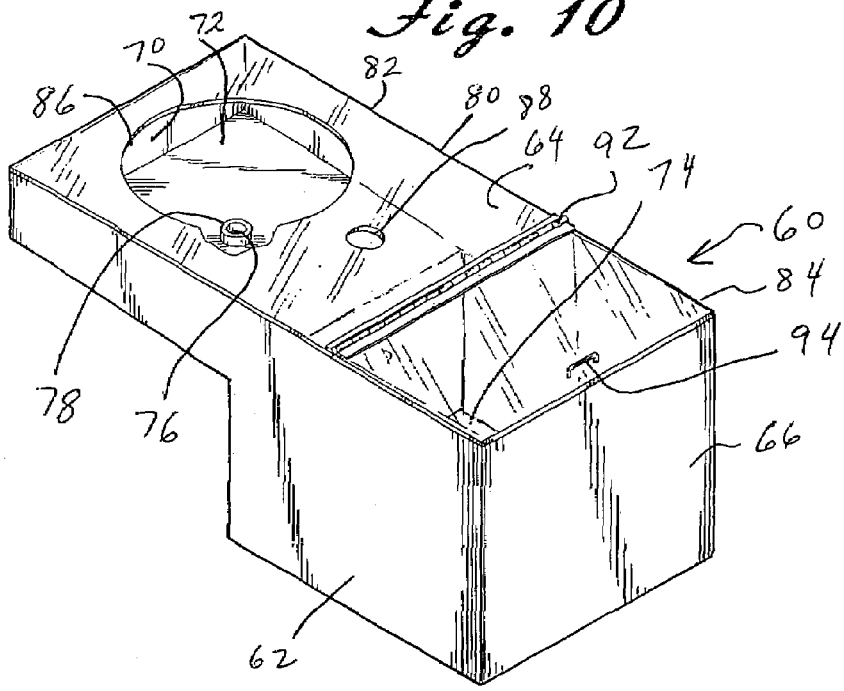
FIG. 10 is a perspective view of the tank shown in FIG. 9.

To prevent the water or other liquid 48 from the nozzle 46 (along with the metal grindings) from being sprayed throughout the interior of the housing 12, it is possible to substantially totally enclose the working components in a watertight tank 60. This embodiment of the invention is shown in FIGS. 9 and 10. The water-tight tank 60 is shown in cross-section in its operative position within the housing 12 in FIG. 9 and is shown in perspective (with a portion cut away) in FIG. 10.

The tank 60 includes left and right side walls 62 and 64, a rear wall 66 and first and second front walls 68 and 70. The tank further includes first and second bottom walls 72 and 74. As shown most clearly in FIG. 9, the first bottom wall 72 is angled downwardly and rearwardly so that any water, metal filings or other debris that fall onto the wall 72 drain rearwardly down into the main tank section. An opening 76 is centrally located in the bottom wall 72 to allow the drive shaft 32 to pass therethrough. A waterproof bushing 78 prevents fluid from passing down through the opening 76.

The tank 60 also includes an upper wall 80 preferably formed in two parts: a forward portion 82 and a rear portion 84. Preferably, both portions 82 and 84 of the upper wall 80 are formed of a transparent material such as acrylic.

The forward upper wall portion 82 has an aperture 86 formed in the center thereof. This aperture is essentially the same diameter as the drum 24 of the turret 14. As a result, the lower portion of the drum 24 extends downwardly into the tank 60 while the upper portion of the drum 24 lies above the tank 60. A second aperture 88 formed in the upper wall 82 allows the drive shaft 44 of the motor 42 to pass therethrough. An appropriate bearing 90 provides a relatively water-tight seal.

The rear upper wall portion 84 is preferably hinged to the forward upper wall portion 82 through the use of a horizontally disclosed hinge 92. Utilizing the handle 94, the rear upper wall portion 84 can be lifted so as to expose the interior of the tank. This can be done when it is desired to clean out the tank. In order to gain access to the tank 60, the cabinet 12 is provided with a door 96 at the back thereof which can be opened utilizing the handle 98.

Because the liquid or cooling fluid 48 accumulates in the tank 60, it can be recirculated to save energy and prevent pollution. A pump 100 or the like located at the bottom of the tank 60 can pump the spent liquid 48 through appropriate piping back to the nozzle 46. The manner in which this is done is believed to be well known in the art. Accordingly, a detailed description thereof is not believed to be necessary.

Figure 11:
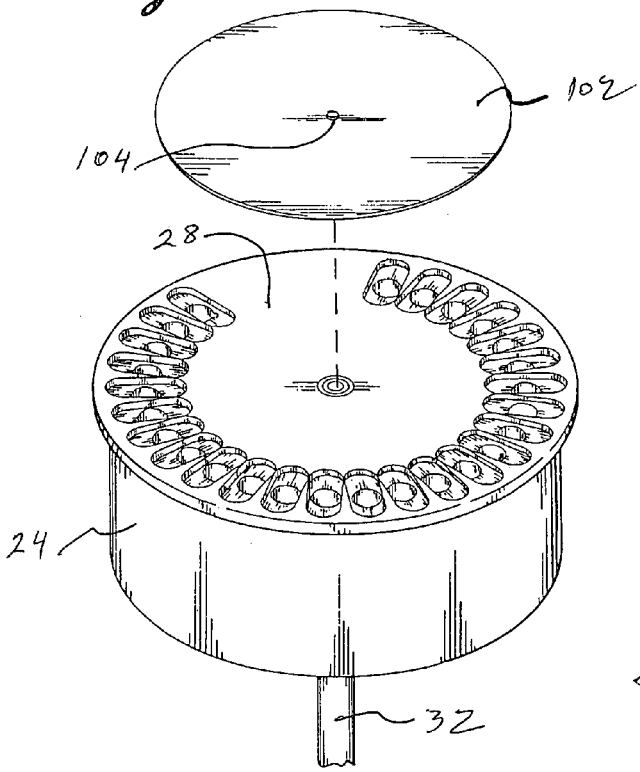
FIG. 11 is an exploded perspective view illustrating the circular shims used to adjust the length of the exposed punch tips.
Figure 12:
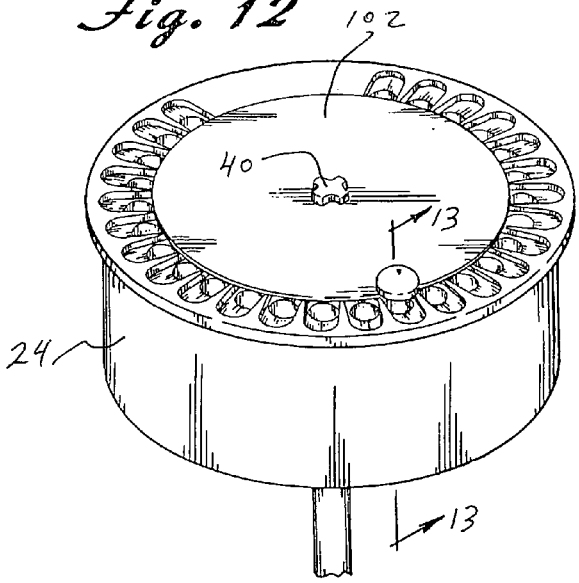
FIG. 12 is a view similar to FIG. 11 showing a shim in place.
Figure 13:
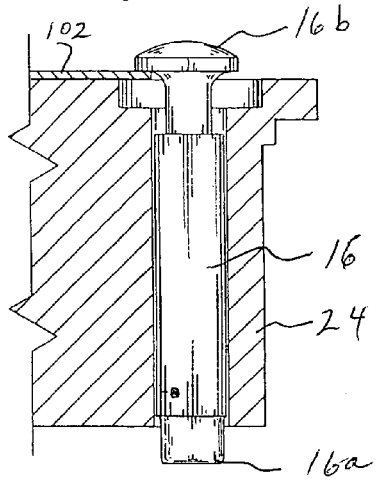
FIG. 13 is a cross-sectional view taken through the line 13-13 of FIG. 12.

Although the punches, such as 16, 18 and 20, are normally of uniform length, the shape and depth of the recessed tips 16*a*, 18*a* and 20*a*, can vary. Accordingly, it is sometimes desirable to vary the length of the tip portions that are exposed on the underside of the turret 14. To accomplish this, the invention includes one or more circular discs such as shown at 102 in FIGS. 11, 12 and 13. The diameter of the disc 102 is less than the distance between opposing holes 26. In this way and as best seen in FIG. 13, the outer edge of the disc 102 underlies the enlarged heads such as 16*b* of the punch 16 in order to limit the downward movement of the punch 16. As a result, the length of the exposed tip 16*a* is shortened.

As should be readily apparent, because the disc 102 is circularly shaped and symmetrical, all of the punches in the turret will be positioned as shown in FIG. 13. The disc 102, therefore, functions as a shim. As should also be readily apparent, several different discs 102 can be employed or discs of different sizes can be used in order to vary the exposed length of the tips of the punches. Furthermore, the center of the disc 102 is provided with an aperture 104 and can be held in place utilizing the same screw or knob 40 as used to hold the cover plate 38 in place. For convenience of illustration, the cover plate 38 is not shown in FIGS. 11, 12 or 13.

The present invention may be embodied in other specific forms without departing from the spirit or essential attributes thereof and accordingly, reference should be made to the appended claims rather than to the foregoing specification as indicating the scope of the invention.

I claim:

1. An apparatus for removing the tips from tablet punches comprising:

a circular turret for supporting a plurality of punches for rotational movement about a substantially vertical axis, said turret having a plurality of substantially vertically aligned holes around the periphery thereof extending from the upper portion of said turret to the lower portion of said turret and wherein each of said holes is adapted to support a punch in a substantially vertical orientation with the tips of said punches being exposed below the lower portion of said turret;

a cutting wheel positioned below said turret and being located in a position in the path of said tips of said punches as said turret rotates so as to be adapted to remove said tips, said cutting wheel being mounted for rotation about an axis which is at a slight angle from the vertical;

means for rotating said turret at a relatively low speed;

means for rotating said cutting wheel at a relatively high speed;

nozzle means for spraying a cooling liquid at the position where said cutting wheel engages the tips of the punches in order to cool the same, and a substantially watertight tank surrounding said cutting wheel, said nozzle and the lower portion of said turret for collecting the liquid and metal grindings from said nozzle and from the cutting of said tips by said cutting wheel.

2. An apparatus for removing the tips from tablet punches as claimed in claim 1 wherein said tank includes an upper wall including a circular aperture therein, said turret extending through said aperture so that said upper portion of said turret is above said upper wall and said lower portion of said turret is below said upper wall.

3. An apparatus for removing the tips from tablet punches as claimed in claim 2 wherein said upper wall includes a hinged door to allow access to the interior of said tank.

4. An apparatus for removing the tips from tablet punches as claimed in claim 1 wherein the upper surface of said turret includes an elongated opening therein adjacent each hole to enable the heads of said punches to be grasped and manually removed.

5. An apparatus for removing the tips from tablet punches as claimed in claim 1 wherein said angle is from approximately 3 to approximately 5 degrees from the vertical.

* * * * *